US011821171B2

(12) United States Patent
Saiki et al.

(10) Patent No.: US 11,821,171 B2
(45) Date of Patent: Nov. 21, 2023

(54) WORK MACHINE

(71) Applicant: KOBELCO CONSTRUCTION MACHINERY CO., LTD., Hiroshima (JP)

(72) Inventors: Seiji Saiki, Hiroshima (JP); Yoichiro Yamazaki, Hiroshima (JP); Hitoshi Sasaki, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 237 days.

(21) Appl. No.: 17/423,578

(22) PCT Filed: Nov. 29, 2019

(86) PCT No.: PCT/JP2019/046887
§ 371 (c)(1),
(2) Date: Jul. 16, 2021

(87) PCT Pub. No.: WO2020/158157
PCT Pub. Date: Aug. 6, 2020

(65) Prior Publication Data

US 2022/0112685 A1 Apr. 14, 2022

(30) Foreign Application Priority Data

Jan. 28, 2019 (JP) ..... 2019-012193

(51) Int. Cl.
*E02F 9/20* (2006.01)
*E02F 9/26* (2006.01)

(52) U.S. Cl.
CPC ..... *E02F 9/205* (2013.01); *E02F 9/2029* (2013.01); *E02F 9/267* (2013.01)

(58) Field of Classification Search
CPC ..... E02F 9/205; E02F 9/2029; E02F 9/267; B66C 13/16; B66C 13/40; B66C 13/54; B66C 15/065
See application file for complete search history.

(56) References Cited

U.S. PATENT DOCUMENTS

2002/0015018 A1* 2/2002 Shimazu ..... E02F 9/26 345/102
2004/0186687 A1* 9/2004 Ogura ..... E02F 9/268 702/185

(Continued)

FOREIGN PATENT DOCUMENTS

CN 1335437 A 2/2002
CN 103231992 A 8/2013

(Continued)

OTHER PUBLICATIONS

Office Action dated Apr. 6, 2022 issued in the corresponding Chinese Patent Application No. 201980090160.0.

(Continued)

*Primary Examiner* — Mussa A Shaawat
(74) *Attorney, Agent, or Firm* — Carrier, Shende & Associates P.C.; Joseph P. Carrier; Jeffrey T. Gedeon

(57) ABSTRACT

A work machine 10 includes: a load detection unit 22*a* that detects a load on an operation mechanism 100; information output devices 43, 44, and 41*a* that output at least one of an image, a sound, and a vibration to an operator; and a control unit 47*a* that controls, according to the magnitude of a load detected by the load detection unit 22*a*, one or more of the level of at least one of the color intensity, the brightness, and the transparency of an image output by the information output device 44, at least one of the intensity and the level of frequency of a sound output by the information output device 43, and at least one of the intensity and the level of (Continued)

frequency of a vibration output by the information output device 41*a*.

4 Claims, 9 Drawing Sheets

(56) References Cited

U.S. PATENT DOCUMENTS

| | | | | |
|---|---|---|---|---|
| 2014/0172128 | A1* | 6/2014 | Johnson | G07C 5/008 700/83 |
| 2017/0175364 | A1* | 6/2017 | Hasegawa | G06T 11/40 |
| 2017/0183845 | A1* | 6/2017 | Izumikawa | E02F 3/32 |
| 2019/0048560 | A1* | 2/2019 | Misaki | E02F 9/261 |
| 2020/0340208 | A1* | 10/2020 | Kitajima | B66C 13/18 |
| 2020/0393827 | A1* | 12/2020 | Hayashi | B66C 13/40 |
| 2021/0087794 | A1* | 3/2021 | Yamamoto | E02F 9/24 |
| 2021/0221654 | A1* | 7/2021 | Yodawara | B66C 13/48 |
| 2021/0246626 | A1* | 8/2021 | Yamamoto | G08B 21/24 |
| 2021/0262195 | A1* | 8/2021 | Nishi | G06F 3/14 |

FOREIGN PATENT DOCUMENTS

| | | | |
|---|---|---|---|
| CN | 106715803 | A | 5/2017 |
| JP | H06-035362 | U | 5/1994 |
| JP | 2002-332666 | A | 11/2002 |
| JP | 2004-288170 | A | 10/2004 |
| JP | 2015190114 | A | 11/2015 |
| JP | 5956386 | B2 | 7/2016 |
| JP | 2016-186210 | A | 10/2016 |
| JP | 2018-112065 | A | 7/2018 |
| JP | 2019-007139 | A | 1/2019 |
| WO | 2016/111148 | A1 | 7/2016 |
| WO | 2017/183707 | A1 | 10/2017 |

OTHER PUBLICATIONS

Office Action dated Jan. 30, 2023, issued in the corresponding European Patent Application No. 19 913 142.6.

Extended European Search Report dated Jan. 12, 2022 issued in corresponding European patent application No. 19913142.6.

* cited by examiner

WORK MACHINE

TECHNICAL FIELD

The present invention relates to a work machine such as a construction machine.

BACKGROUND ART

For this type of a work machine, a technology disclosed in, for example, Patent Document 1 has been proposed. This Patent Document 1 proposes a technology in which, in order to provide an operator with easy-to-understand malfunction information of a work machine, one of two screens that is currently displayed in an information display device displays a malfunction of an engine or the like of the work machine when the degree of the malfunction is small. Further, a technology has been proposed, in which if the degree of the malfunction is large and one screen is being displayed in the information display device, then the one screen is automatically switched to the other screen to display the malfunction on the other screen.

CITATION LIST

Patent Literature

Patent Literature 1: Japanese Patent No. 5956386

SUMMARY OF INVENTION

Technical Problem

However, it is desirable to guide an operator to operate a work machine before a malfunction occurs in a constituent element of the work machine so that such a malfunction will not occur.

Accordingly, an object of the present invention is to provide a work machine capable of guiding an operator to operate the work machine before a malfunction occurs in a constituent element of the work machine so that such a malfunction will not occur.

Solution to Problem

To this end, a work machine in accordance with the present invention includes:

an operation mechanism;

a load detection element which detects a load applied to the operation mechanism;

an information output device which outputs at east one of an image, a sound, and a vibration to an operator; and a control element which performs one or more controls, according to a magnitude of a load on the operation mechanism detected by the load detection element, among control of a level of at least one of color intensity, brightness, and transparency of at least a part of an image output by the information output device, control of at least one of intensity and a level of frequency of a sound output by the information output device, and control of at least one of an intensity and a level of frequency of a vibration output by the information output device.

DESCRIPTION OF EMBODIMENTS

First Embodiment

Figure 1:
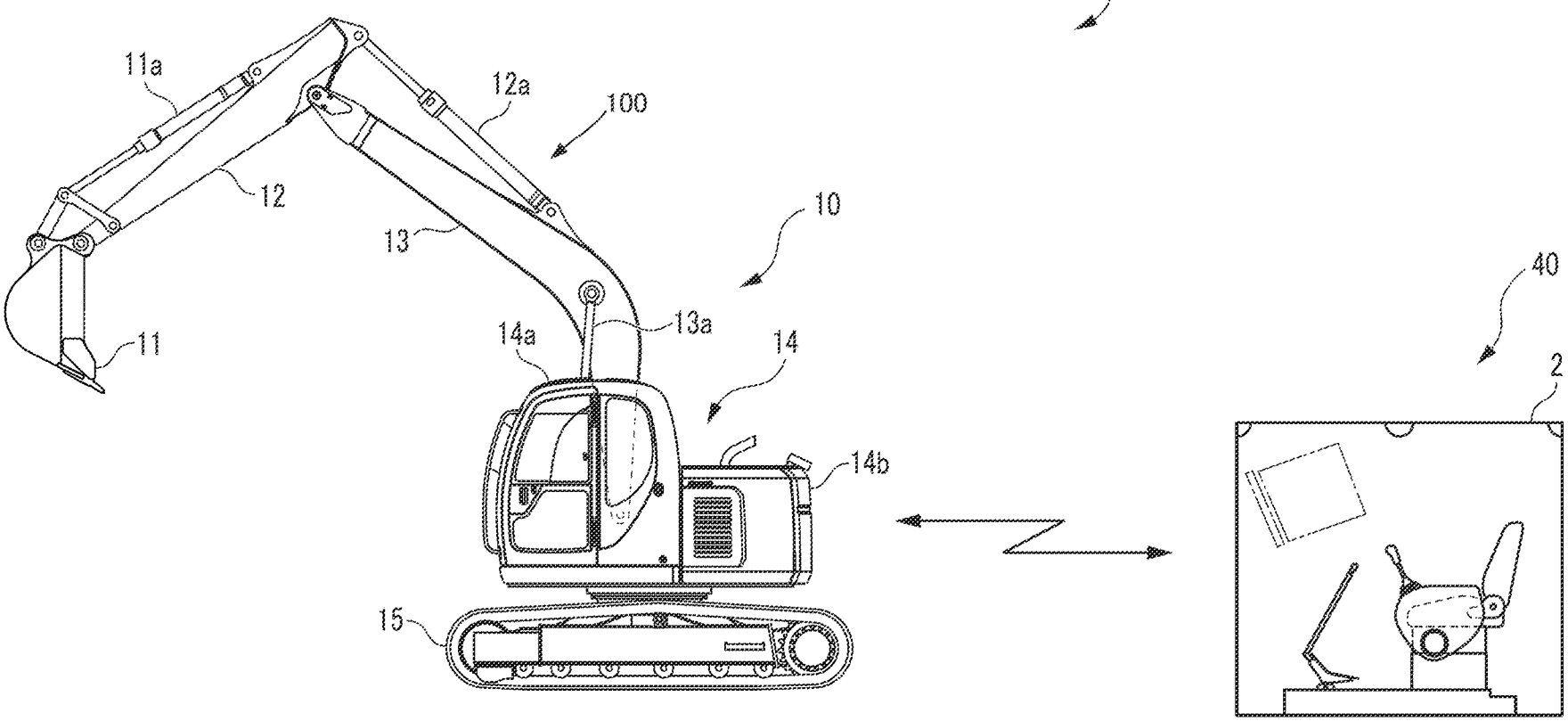
FIG. 1 is a diagram illustrating an overall configuration of a remote control system of a work machine to which an embodiment of the present invention has been applied.

A first embodiment of the present invention will be described below with reference to FIG. 1 to FIG. 7C. The present embodiment is an embodiment to which the present invention has been applied to a remote control system 1 configured to enable an operator (operating personnel), who is not illustrated, to remotely control, for example, a work machine 10 by a remote control device 40.

The work machine 10 is, for example, a hydraulic excavator, and includes a front operation mechanism 100 that has an attachment 11, an arm 12, and a boom 13, a swivel body 14, and a traveling body 15. The traveling body 15 is a crawler type traveling body in the illustrated example, and is driven by a hydraulic motor for traveling, which is not illustrated. The traveling body 15 may be a wheel type traveling body.

The swivel body 14 is placed above the traveling body 15, and configured to be capable of swiveling around a yaw axis with respect to the traveling body 15 by a hydraulic motor for swiveling, which is not illustrated. Provided at the rear of the swivel body 14 is a machine room 14*b* that houses hydraulic equipment (a hydraulic pump, a directional switching valve, a hydraulic oil tank, or the like), which is not illustrated, and an engine, which is a power source for a hydraulic pump or the like, and which is not illustrated.

Further, the work machine 10 is a work machine that can be hoarded and operated by a driver, and a driver's cab 14*a* is provided at a front portion of the swivel body 14. An operation device 17 (illustrated in FIG. 2) for steering the work machine 10 is placed in the driver's cab 14*a*. The operation device 17 includes operation levers, operation pedals, operation switches, and the like, which are not illustrated.

The front operation mechanism 100 constitutes an example of the operation mechanism in the present invention, and includes the attachment 11, the arm 12, and the boom 13, and hydraulic cylinders 11*a*, 12*a*, and 13*a* that drive the attachment 11, the arm 12, and the boom 13, respectively. Further, the boom 13 is attached to the front portion of the swivel body 14 such that the boom 13 can be swung with respect to the swivel body 14 by the hydraulic cylinder 13*a*. The arm 12 is attached to the tip of the boom 13 such that the arm 12 can be swung with respect to the boom 13 by the hydraulic cylinder 12*a*. The attachment 11 is attached to the tip of the arm 12 such that the attachment 11 can be swung with respect to the arm 12 by the hydraulic cylinder 11*a*. Here, in the present embodiment, each of the hydraulic cylinders 11*a*, 12*a*, and 13*a* corresponds to an actuator as a constituent element of an operation mechanism in the present invention, and each of the attachment 11, the arm 12, and the boom 13 corresponds to a driven part as a constituent element of the operation mechanism in the present invention.

Although the bucket is illustrated as an attachment 11 in FIG. 1, the attachment 11 may be any other type of attachment (a crusher, a breaker, a magnet, or the like). Further, the work machine 10 can further include actuators (e.g., a hydraulic actuator for driving a bulldozer, and a hydraulic actuator included in an attachment such as a crusher) other than the hydraulic motor for traveling, the hydraulic motor for swiveling, and the hydraulic cylinders 11*a*, 12*a*, 13*a* described above. Further, some actuators of the work machine 10 (e.g., an actuator for swiveling) may be electric actuators.

In the work machine 10 having the above-mentioned configuration, the operation levers or the operation pedals of the operation device 17 are operated while the engine is running, thereby to actuate the hydraulic motor for traveling, the hydraulic motor for swiveling, the actuators of the hydraulic cylinders 11*a*, 12*a*, and 13*a*, and the like, thus making it possible to steer the work machine 10. In this case, the operations of the actuators based on the control through the operation device 17 can be performed in the same manner as with, for example, a publicly known work machine.

Figure 2:
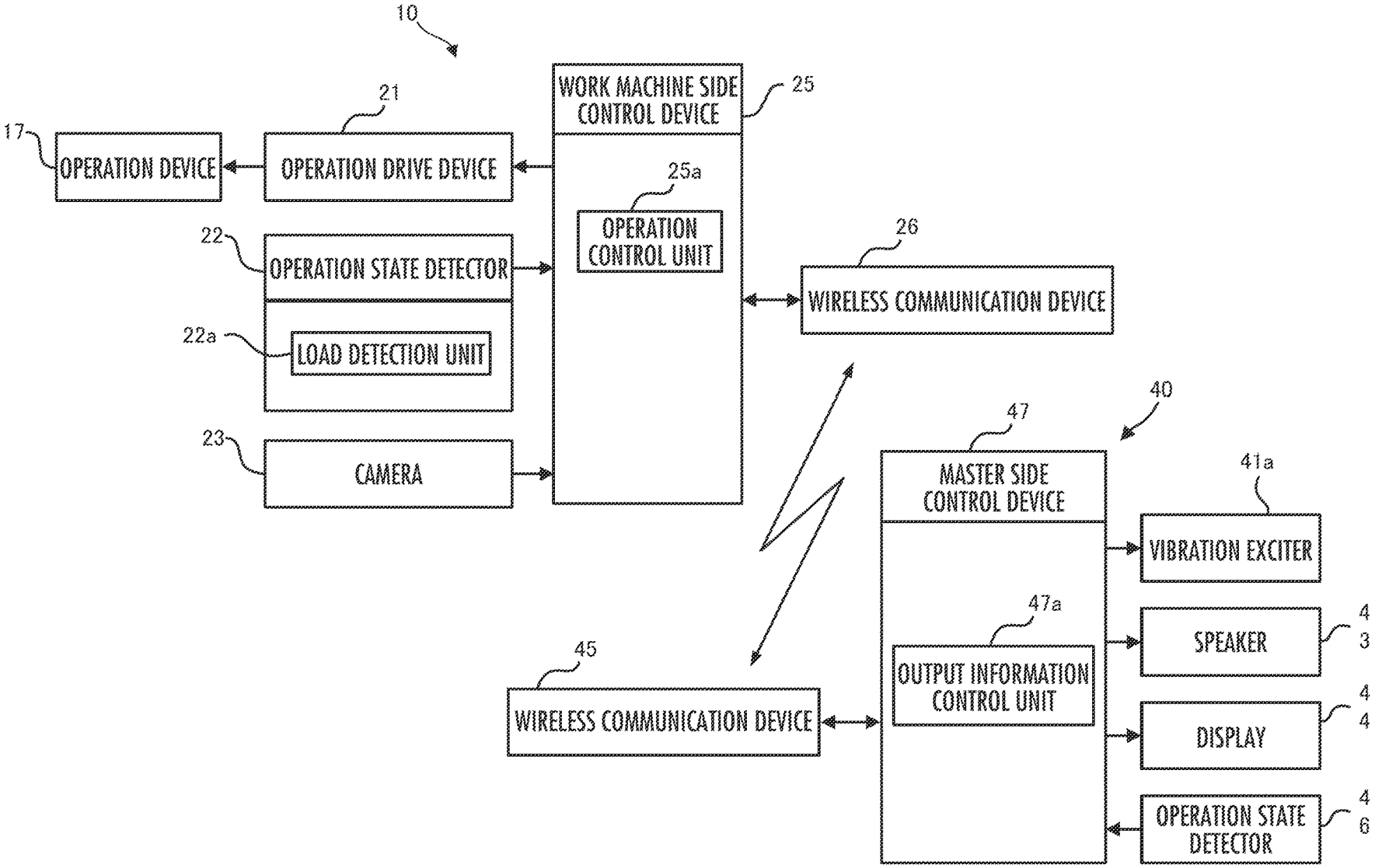
FIG. 2 is a block diagram illustrating a configuration related to the control of the remote control system of the embodiment.

Further, in the present embodiment, an electrically powered operation drive device 21 that drives the operation device 17 is mounted on the work machine 10 as illustrated in FIG. 2 in order to enable the remote control of the work machine 10. The operation drive device 21 has a plurality of electric motors (not illustrated) and is installed in the driver's cab 14*a*. Further, the operation drive device 21 is connected to the operation device 17 such that each of the operation levers or operation pedals included in the operation device 17 can be driven by the electric motors. If the remote control of the work machine 10 is not performed, then the operation drive device 21 can be removed from the work machine 10.

As illustrated in FIG. 2, the work machine 10 further includes an operation state detector 22 for detecting the operation state of the work machine 10, a camera 23 that photographs a predetermined area around the work machine 10, a work machine side control device 25 capable of executing various types of control processing, and a wireless communication device 26 for communicating with the remote control device 40.

The operation state detector 22 in the present embodiment includes a load detection unit 22*a* that detects a load applied to each actuator of the front operation mechanism 100. The load detection unit 22*a* corresponds to a load detection element in the present invention. The load detection unit 22*a* is composed of a pressure sensor that detects, for example, the pressure of hydraulic oil supplied to each of the hydraulic cylinders 11*a*, 12*a*, and 13*a*, or the pressure of hydraulic oil discharged from each of the hydraulic cylinders 11*a*, 12*a*, and 13*a*. In this case, the pressure of hydraulic oil detected by the pressure sensor for each of the hydraulic cylinders 11*a*, 12*a*, and 13*a* represents the load applied to each of the hydraulic cylinders 11*a*, 12*a*, and 13*a*.

The load detection unit 22*a* may be provided with, for example, a force sensor that detects the translational force generated by the hydraulic cylinders 11*a*, 12*a*, and 13*a*, or a force sensor that detects the rotational force (torque) of each of the boom 13, the arm 12, and the attachment 11 corresponding to the swivel body 14, the boom 13, and the arm 12, respectively, instead of the pressure sensor.

Further, although not illustrated, the operation state detector 2:2 includes, in addition to the load detection unit 22*a*, for example, a detector that detects the rotational angle of the swing motion of each of the attachment 11, the arm 12, and the boom 13 (or the stroke lengths of the hydraulic cylinders 11*a*, 12*a*, and 13*a*), a detector that detects the swivel angle of the swivel body 14, and a detector that detects a driving speed of the traveling body 15. The operation state detector 22 can thither include, in addition to the detectors described above, for example, a detector that detects the tilt angle of the swivel body 14 or the traveling body 15, an inertial sensor that detects the angular velocity or the acceleration of the swivel body 14, and other sensors.

The camera 23 is mounted on the ceiling of the drivers cab 14*a*, or the inside of the driver's cab 14*a*, or the like such that, for example, an area in front of the swivel body 14 can be photographed. A plurality of cameras 23 may be mounted on the work machine 10 such that a plurality of areas around the work machine 10 can be photographed.

The work machine side control device 25 is composed of one or more electronic circuit units that include, for example, microcomputers, memories, interface circuits and the like, and can acquire, as necessary, a captured image signal of the camera 23 or a detection signal of the operation state detector 22. In addition, the work machine side control device 25 can communicate, as necessary, with the remote control device 40 through the intermediary of the wireless communication device 26.

Further, the work machine side control device 25 has, as a function implemented by both or one of hardware configuration and a program (software configuration) that have been installed, a function as an operation control unit 25*a* which performs the operation control of the work machine 10 according to an operation through the operation device 17 or in response to an operation command given front the remote control device 40 through the intermediary of the wireless communication device 26. The operation control unit 25*a* can perform the operation control of the operation drive device 21 (consequently the operation control of the operation device 17), and can perform the operation control of an engine.

Figure 3:
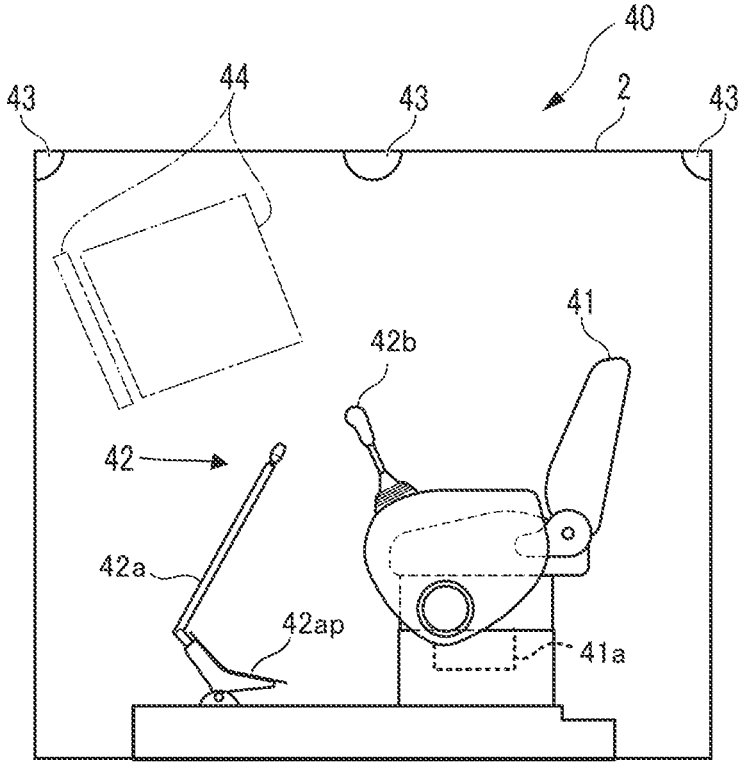
FIG. 3 is a diagram illustrating the configuration of a remote control device of the remote control system of the embodiment.

A description will now be given of the remote control device 40. As illustrated in FIG. 3, the remote control device 40 has, in a remote control room 2, a seat 41 on which an operator (not illustrated) sits, an operation device 42 operated by the operator to perform remote control of the work machine 10, speakers 43 as output devices of acoustic information (auditory information), and a display 44 as an output device of display information (visual information). Further, an electrically powered vibration exciter 41*a* that can vibrate the seat 41 is incorporated in the seat 41.

Further, as illustrated in FIG. 2, the remote control device 40 has a wireless communication device 45 for performing wireless communication with the work machine 10, an operation state detector 46 for detecting the operation state of the operation device 42, and a master side control device 47 that can execute various types of control processing. The wireless communication device 45 and the master side control device 47 may be placed at either the inside or the outside of the remote control room 2.

The operation device 42 can adopt a configuration that is the same as or similar to that of, for example, the operation device 17 of the work machine 10. For example, the operation device 42 illustrated in FIG. 3 mainly includes a control lever 42*a* with a control pedal 42*ap* installed in front of the seat 41 such that the operator seated on the seat 41 can operate, and control levers 42*b* mounted on consoles on the left and right of the seat 41. However, the operation device 42 may have a different configuration from the operation device 17 of the work machine 10. For example, the operation device 42 may be a portable operation device having a joystick, an operation button, or the like.

The operation state detector 46 corresponds to a first detection element in the present invention. The operation state detector 46 includes, for example, a potentiometer, a contact switch, and the like incorporated in the operation device 42, and is configured to output detection signals indicating the operation state of each of the operation parts (the control levers 42*a*, 42*b*, the control pedal 42*ap*, and the like) of the operation device 42.

The speakers 43 are placed, for example, at a plurality of locations around the remote control room 2, e.g., at the front the rear and both left and right sides of the remote control room 2. The display 44 is composed of, for example, a liquid crystal display, a head-up display, or the like, and is placed on the front side of the seat 41 such that the display 44 can be seen by the operator seated on the seat 41. In the present embodiment, the speakers 43, the display 44, and the vibration exciter 41*a* can function as an information output device in the present invention.

The master side control device 47 is composed of one or more electronic circuit units that include, for example, microcomputers, memories, interface circuits and the like, and can acquire, as necessary, a detection signal of the operation state detector 46. In addition, the master side control device 47 can communicate, as necessary, with the work machine side control device 25 through the intermediary of the wireless communication device 45 and the wireless communication device 26 of the work machine 10. This communication enables the master side control device 47 to transmit an operation command of the work machine 10 specified according to the operation state of the operation device 42 detected by the operation state detector 46 to the work machine side control device 25, or to receive various types of information on the work machine 10 (a captured image by the camera 23, the detection information of the operation state of the work machine 10, and the like) front the work machine side control device 25.

Further, the master side control device 47 has, as a function implemented by both or one of a hardware configuration and a program (a software configuration), which are installed, a function as an output information control unit 47*a* that controls the speakers 43, the display 44, and the vibration exciter 41*a*. The output information control unit 47*a* corresponds to a control element in the present invention.

Next, the operation of the remote control system 1 of the present embodiment will be specifically described. When the operator seated on the seat 41 in the remote control room 2 performs a predetermined startup operation (e.g., turning on a start switch, which is not illustrated, of the operation device 42, or a voice input operation) to start an operation by the work machine 10, the master side control device 47 transmits a startup command to the work machine side control device 25 through the wireless communication devices 45 and 26 in response to the startup operation.

At this time, the work machine side control device 25 carries out, by the operation control unit 25*a*, the control processing for starting the engine of the work machine 10 upon receipt of the startup command. Then, when the startup of the engine is completed, the work machine side control device 25 transmits engine startup completion information, which indicates that the engine has started, to the master side control device 47 through the wireless communication devices 26 and 45.

Upon receipt of the engine startup completion information, the master side control device 47 causes the speakers 43 to output audio information indicating that the engine of the work machine 10 has started up, or causes the display 44 to show display information indicating that the engine has started up. This enables the operator to recognize that the engine of the work machine 10 has started up.

Figure 9A:
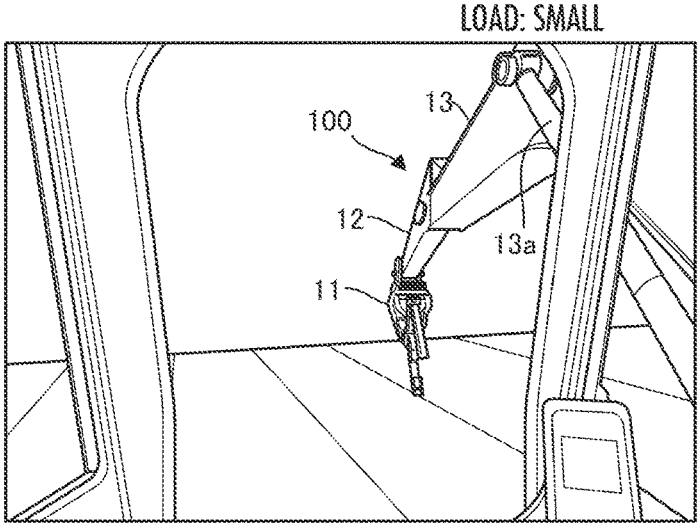
FIG. 9A to 9C are diagrams for explaining an example of image display control in a third embodiment.

Further, the master side control device 47 sequentially acquires (receives), by the communication with the work machine side control device 25, a captured image (including a captured image of the front side of the swivel body 14) by the camera 23 of the work machine 10. Then, the master side control device 47 causes the acquired captured image to be shown on the display 44. For example, as illustrated in FIG. 9A, the captured image of the front side of the swivel body 14 (the captured image from the inside of the driver's cab 14*a* in the illustrated example) is shown on the display 44.

Subsequently, the operator operates the operation device 42 to cause, when necessary, the traveling body 15 of the work machine 10 to perform a traveling operation, the swivel body 14 to perform a swiveling operation, or the front operation mechanism 100 to perform its operation. At this time, the master side control device 47 sequentially detects the operation state of the operation device 42 through the intermediary of the operation state detector 46, and transmits an operation command based on the operation state to the work machine side control device 25.

At this time, the work machine side control device 25 controls the operation drive device 21 so as to operate the operation device 17 of the work machine 10 in response to a received operation command. Consequently, the traveling operation of the traveling body 15 of the work machine 10, the swiveling operation of the swivel body 14, or the operation of the front operation mechanism 100 is carried out according to the operation of the operation device 42 performed by the operator. Consequently, required work by the work machine 10 is accomplished.

During such an operation, the work machine side control device 25 sequentially acquires detection information obtained by the operation state detector 22 and transmits the detection information to the master side control device 47 through the wireless communication devices 26 and 45. At this time, the output information control unit 47*a* of the master side control device 47 generates, while sequentially updating, an image showing the overall attitude state (real-time attitude state) of the front operation mechanism 100 defined according to the detection value of each of the swing rotational angles of the attachment 11, the arm 12, and the boom 13 (or the detection value of the stroke length of each of the hydraulic cylinders 11*a*, 12*a*, and 13*a*), and causes the image (hereinafter referred to as the operation mechanism state image) to be displayed on a partial screen area of the display 44.

Thus, the operation mechanism state image illustrated in, for example, FIG. 4A or FIG. 5A or FIG. 6A or FIG. 7A is displayed on the display 44. The operation mechanism state image is a part of an image to be normally displayed on the display 44 while the work machine 10 is operating. Here, the work mechanism state images exemplified in each of FIGS. 4A, 5A, 6A, and 7A are images showing the front operation mechanism 100 in, for example, a side view. However, the operation mechanism state image may be, for example, a perspective view or the like of the front operation mechanism 100 as seen from the driver's cab 14*a* side of the work machine 10. Further, the image of each part of the front operation mechanism 100 in the operation mechanism state image may be an arbitrarily deformed image.

Figure 7A:
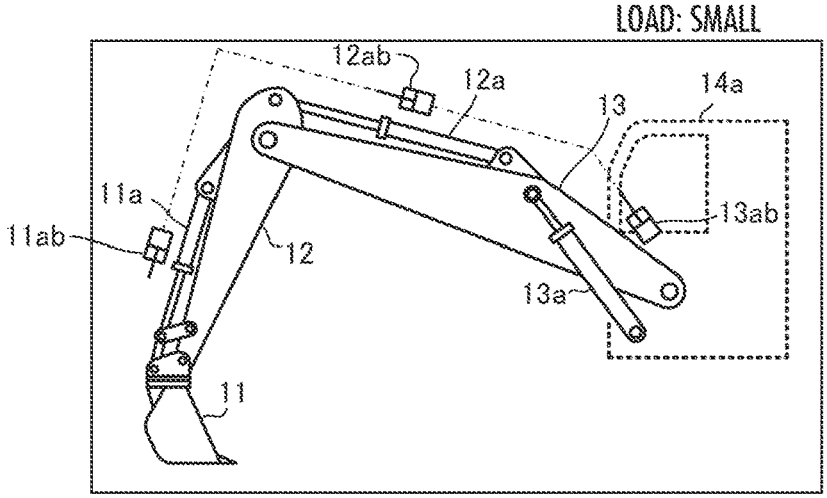
FIG. 7A to FIG. 7C are diagrams for explaining a fourth example of the image display control in the first embodiment.

Further, the operation mechanism state image may include diagrams 11*ab*, 12*ab*, and 13*ab* showing the arrangement modes of the actuators (the hydraulic cylinders 11*a*, 12*a*, and 13*a*) included in the front operation mechanism 100 as illustrated in, for example, FIG. 7A. Instead of the diagrams 11*ab*, 12*ab*, and 13*ab* showing the arrangement modes of the actuators (the hydraulic cylinders 11*a*, 12*a*, and 13*a*) included in the front operation mechanism 100, or in addition to the diagrams 11*ab*, 12*ab*, and 13*ab*, a diagram showing the arrangement mode of the attachment 11, the arm 12, and the boom 13 (e.g., a diagram in a form in which line segments corresponding to the attachment 11, the arm 12, and the boom 13 are connected to each other) may be added to an operation mechanism state image.

Further, the output information control unit 47*a* of the master side control device 47 sequentially monitors the detection information of the load on each of the hydraulic cylinders 11*a*, 12*a*, and 13*a* of the front operation mechanism 100 by the load detection unit 22*a* among the detection information of the operation state detector 22 transmitted from the work machine side control device 25 while the work machine 10 is in operation.

Then, the output information control unit 47*a* causes the operation mechanism state image to be displayed on the display 44 such that the state amount of one or more of brightness, color intensity, and transparency of at least a part of the operation mechanism state image is changed according to the detection information of the load on each of the hydraulic cylinders 11*a*, 12*a*, and 13*a*. The following will describe some examples of the display form of the operation mechanism state image based on the load on each of the hydraulic cylinders 11*a*, 12*a*, and 13*a*.

First Example

Figure 4A:
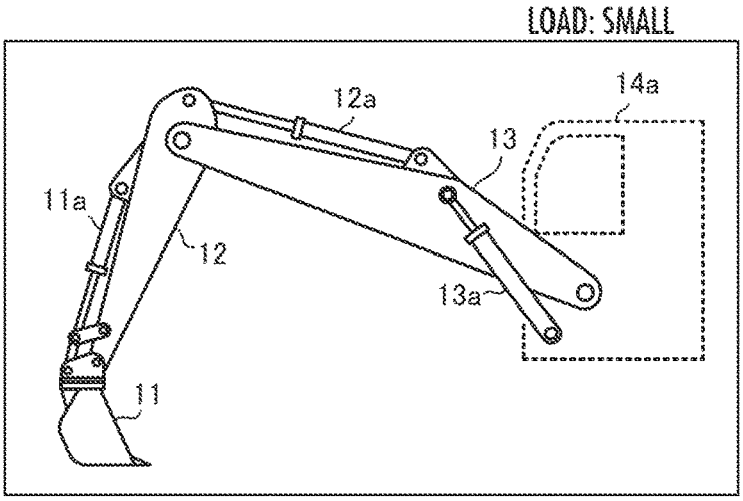
FIG. 4A to FIG. 4C are diagrams for explaining a first example of image display control a first embodiment.

A first example will be described with reference to FIG. 4A to FIG. 4C. In a low load state in which the loads on all the hydraulic cylinders 11*a*, 12*a*, and 13*a* are small loads of a predetermined value or less, the entire operation mechanism state image is shown on the display 44 with certain standard brightness, color intensity, and transparency, as illustrated in FIG. 4A. The predetermined value can be set in advance on the basis of experiments or the like as a value at which the risk of degradation of durability or malfunction of the hydraulic cylinders 11*a*, 12*a*, and 13*a* may increase if the hydraulic cylinders 11*a*, 12*a*, and 13*a* are continuously operated with a load higher than the value.

Figure 4B:
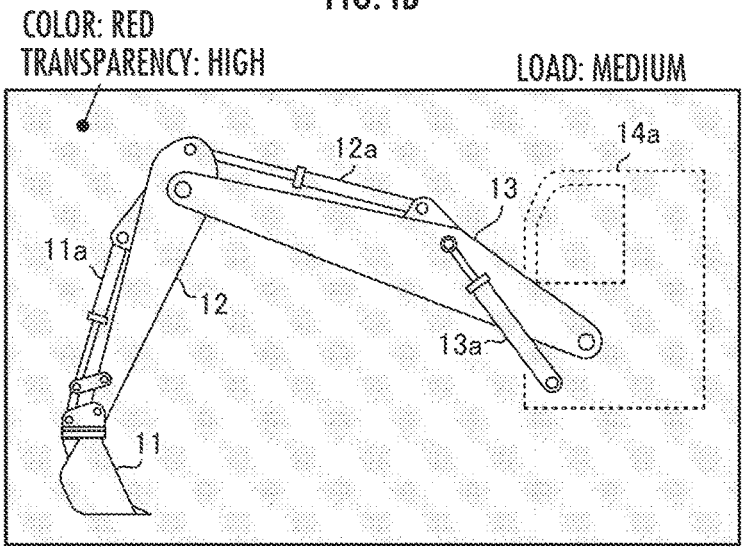
Figure 4C:
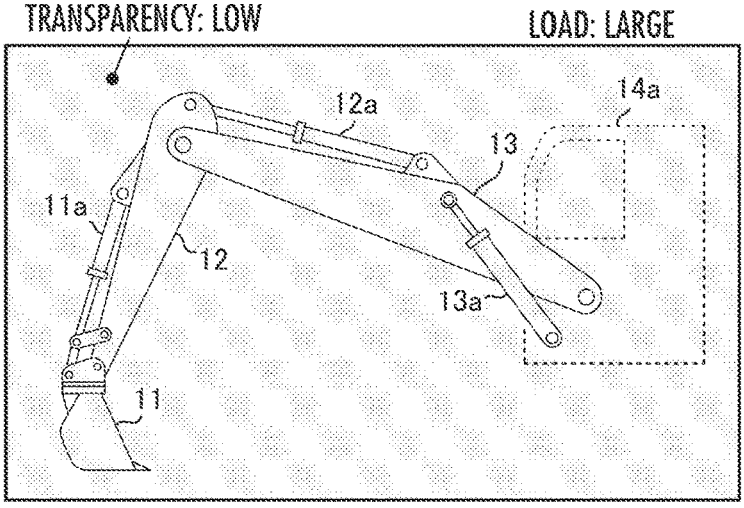

Then, if the load on any one of the hydraulic cylinders 11*a*, 12*a*, and 13*a* increases to be more than the predetermined value, a masking color of a predetermined color is superimposed on the entire operation mechanism state image such that the transparency of the entire operation mechanism state image becomes lower than that in a low load state (FIG. 4A) and the transparency decreases as the load (>predetermined value) increases, as illustrated in FIG. 4B and FIG. 4C. In this case, the masking color uses a color, such as red, that easily draws the operator's attention. Further, FIG. 4C illustrates a situation in which the load on any one of the hydraulic cylinders 11*a*, 12*a*, and 13*a* is larger than that in FIG. 4B, and the transparency of the entire operation mechanism state image is lower in FIG. 4C than in FIG. 4B.

Consequently, while operating the work machine 10 without boarding the work machine 10, the operator can visually recognize with ease when the load on any one of the hydraulic cylinders 11*a*, 12*a*, and 13*a* increases, and the high or low degree of the magnitude of the load. Thus, the operator can correct the way of moving the front operation mechanism 100 at an appropriate timing to prevent the load on each of the hydraulic cylinders 11*a*, 12*a*, and 13*a* from becoming excessive. As a result, the occurrence of a malfunction such as a failure of the front operation mechanism 100 can be properly prevented.

In the first example, when the load on any one of the hydraulic cylinders 11*a*, 12*a*, and 13*a* becomes larger than a predetermined value, instead of or in addition to decreasing the transparency of the entire operation mechanism state image as the load increases, one or both of the brightness and the color intensity of the entire operation mechanism state image may be changed according to the load. For example, one or both of the brightness and the color intensity of the entire operation mechanism state image may be decreased as the load increases.

Figure 5A:
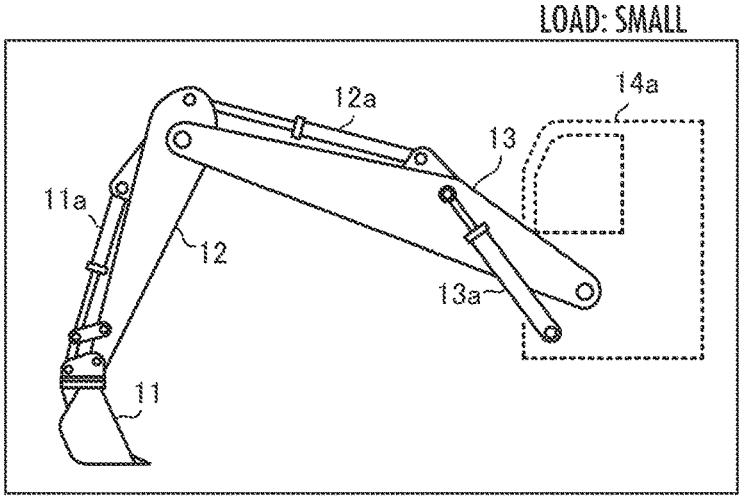
FIG. 5A to FIG. 5C are diagrams for explaining a second example of the image display control in the first embodiment.

(Second example) Referring now to FIG. 5A to FIG. 5C, a second example will be described. In a low load state (FIG. 5A), in which the loads of all the hydraulic cylinders 11*a*, 12*a*, and 13*a* are small loads of a predetermined value or less, the entire operation mechanism state image is displayed on the display 44 with a certain standard brightness, color intensity, and transparency, as with the first example. Further, if the load on any one of the hydraulic cylinders 11*a*, 12*a*, and 13*a* becomes larger than the predetermined value, then a masking color of a predetermined color (e.g., red) is superimposed on the image of the hydraulic cylinder 11*a* or 12*a* or 13*a* with the load thereof larger than the predetermined value (hereinafter referred to as the hydraulic cylinder with increased load X) among the operation mechanism state images such that the transparency of the image of the hydraulic cylinder with increased load X is lower than that of the low load state (FIG. 5A) and the transparency decreases as the load (>the predetermined value) of the hydraulic cylinder with increased load X increases.

Figure 5B:
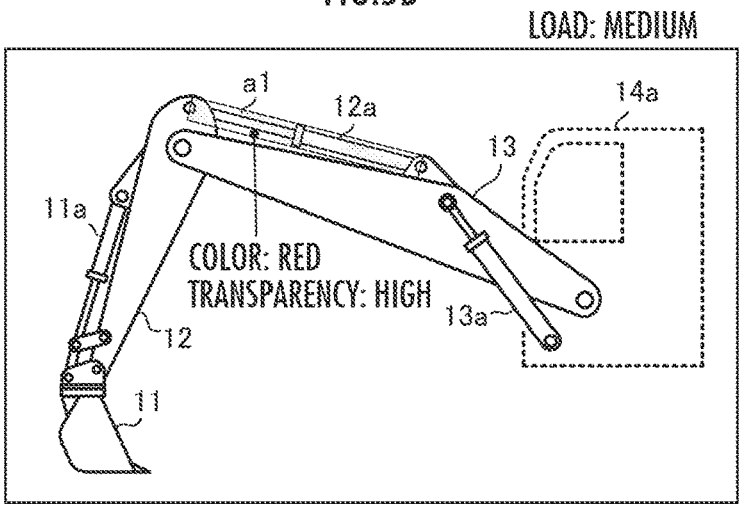
Figure 5C:
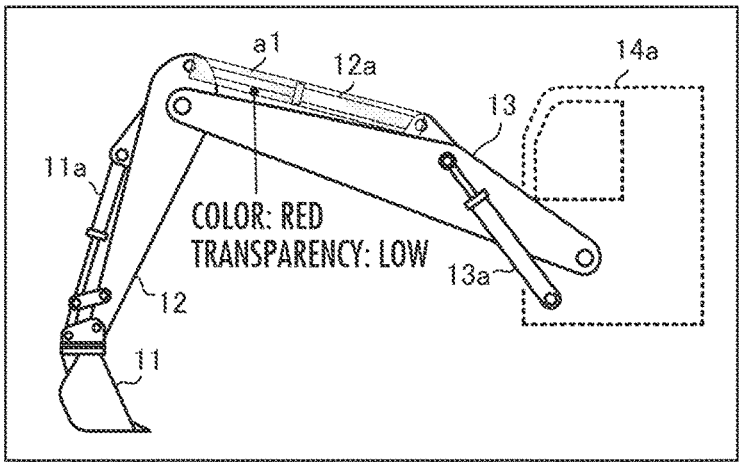

For example, FIG. 5B and FIG. 5C illustrate situations in which the load on the hydraulic cylinder 12*a* among the hydraulic cylinders 11*a*, 12*a*, and 13*a* has become larger than the predetermined value, and the load on the hydraulic cylinder 12*a* has further increased to be higher in FIG. 5C than in FIG. 5B. In these situations, the masking color is superimposed on an area a1 that includes the image of the hydraulic cylinder 12*a* as the hydraulic cylinder with increased load X, thereby decreasing the transparency of the image of the hydraulic cylinder 12*a* to be lower than that of the low load state (FIG. 5A). Further, the load on the hydraulic cylinder 12*a* is higher in FIG. 5C than in FIG. 5B, so that the transparency of the image of the hydraulic cylinder 12*a* is lower in FIG. 5C than in FIG. 5B. If there are a plurality of the hydraulic cylinders with increased load X, then the masking color is superimposed on the image of each of the plurality of the hydraulic cylinders increased load X.

Consequently, while operating the work machine 10 without boarding the work machine 10, the operator can visually recognize with ease when the load on any one of the hydraulic cylinders 11*a*, 12*a*, and 13*a* increases, and the high or low degree of the magnitude of the load. In addition, the operator can visually recognize with ease which one of the hydraulic cylinders 11*a*, 12*a*, and 13*a* is the hydraulic cylinder with increased load X. Thus, the operator can properly correct the way of moving the front operation mechanism 100 at an appropriate timing to decrease the load on the hydraulic cylinder with increased load X. As a result, the occurrence of a failure or the like of the front operation mechanism 100 can be properly prevented.

In the second example, when the load on any one of the hydraulic cylinders 11*a*, 12*a*, and 13*a* becomes larger than a predetermined value, instead of or in addition to decreasing the transparency of the image of the hydraulic cylinder with increased load X as the load on the hydraulic cylinder with increased load X increases, one or both of the brightness and the color intensity of the image of the hydraulic cylinder with increased load X may be changed according to the load on the hydraulic cylinder with increased load X. For example, one or both of the brightness and the color intensity of the image of the hydraulic cylinder with increased load X may be decreased as the load on the hydraulic cylinder with increased load X increases.

Third Example

Figure 6A:
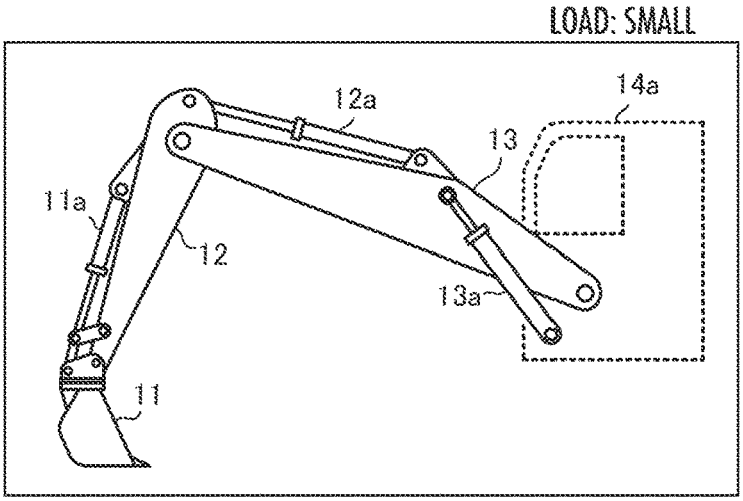
FIG. 6A to 6C are diagrams for explaining a third example of the image display control in the first embodiment.
Figure 6B:
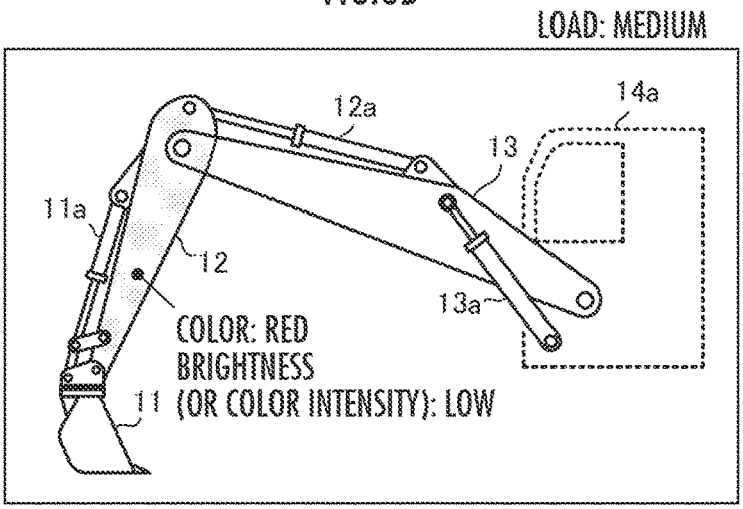
Figure 6C:
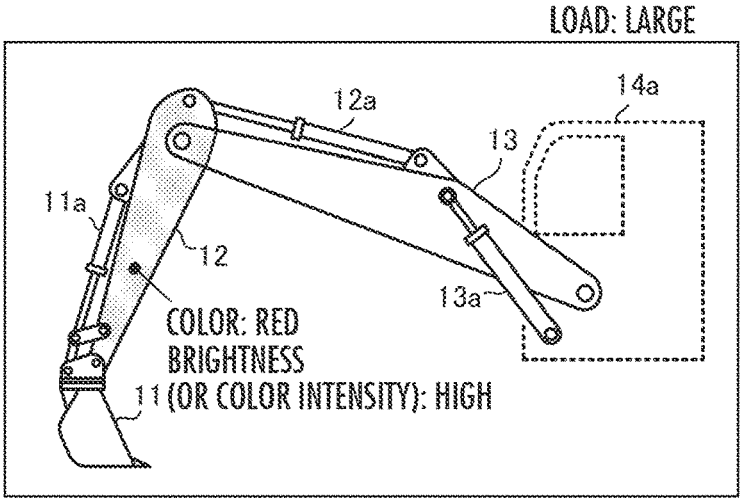

Referring now to FIG. 6*i* to FIG. 6C, a third example will be described. In the low load state in which the loads on all the hydraulic cylinders 11*a*, 12*a*, and 13*a* are small loads of a predetermined value or less (FIG. 6A), the entire operation mechanism state image is shown on a display 44 with a certain standard brightness, color intensity, and transparency, as with the first example. Then, if the load on any one of the hydraulic cylinders 11*a*, 12*a*, and 13*a* becomes larger than the predetermined value, the image of a driven part (the attachment 11 or the arm 12 or the boom 13, which will be hereinafter referred to as the driven part with increased load Y) driven by a hydraulic cylinder with increased load X, the load on which has become larger than the predetermined value, is colored by a predetermined color (e.g., red) in the operation mechanism state image, and the image of the driven part with increased load. Y is shown on a display 44 such that the brightness or the color intensity of the image of the driven part with increased load becomes higher than that of the low load state (FIG. 6A) and the brightness or the color intensity of the driven part with increased load Y increases as the load (>predetermined value) on the hydraulic cylinder with increased load X increases.

For example, FIG. 6B and FIG. 6C illustrate situations in which the load on the hydraulic cylinder 12*a* among the hydraulic cylinders 11*a*, 12*a*, and 13*a* has become larger than the predetermined value, and the load on the hydraulic cylinder 12*a* is even higher in FIG. 6C than in FIG. 6B. In these situations, the brightness or the color intensity of the image of the arm 12, which is the driven part with increased load Y corresponding to the hydraulic cylinder 12*a* as the hydraulic cylinder with increased load X, becomes higher than that of the low load state (FIG. 6A). Further, the load on the hydraulic cylinder 12*a* is higher in FIG. 6C than in FIG. 6B, so that the brightness or the color intensity of the image of the arm 12 (the driven part with increased load Y) is higher in FIG. 6C than in FIG. 6B. If there are a plurality of the hydraulic cylinders with increased load X, then the brightness or the color intensity of the image of each of the driven parts with increased load individually corresponding to the plurality of hydraulic cylinders with increased load X is set as described above.

Consequently, while operating the work machine 10 without boarding the work machine 10, the operator can visually recognize with ease when the load on any one of the hydraulic cylinders 11*a*, 12*a*, and 13*a* increases, and the high or low degree of the magnitude of the load. In addition, the operator can visually recognize with ease which one of the driven parts, namely, an attachment 11, an arm 12, and a boom 13, is the driven part with increased load Y corresponding to the hydraulic cylinder with increased load X. Thus, the operator can properly correct the way of moving a front operation mechanism 100 at an appropriate timing to decrease the load on the hydraulic cylinder with increased load X that drives the driven part with increased load Y. As a result, the occurrence of a failure or the like of the front operation mechanism 100 can be properly prevented.

In the third example, if the load on any one of the hydraulic cylinders 11*a*, 12*a*, and 13*a* becomes larger than the predetermined value, then the brightness or the color intensity of the image of the driven part with increased load Y may be decreased as the load on the hydraulic cylinder with increased load X corresponding to the driven part with increased load Y increases.

Further, instead of or in addition to increasing (or decreasing) the brightness or the color intensity of the image of the driven part with increased load Y as the load on the hydraulic cylinder with increased load X corresponding to the driven part with increased load Y increases, the transparency of the image of the driven part with increased load Y may be changed according to the load on the hydraulic cylinder with increased load X that drives the driven part with increased load Y. For example, the transparency of the image of the driven part with increased load Y may be decreased as the load on the hydraulic cylinder with increased load X increases.

Fourth Example

Figure 7B:
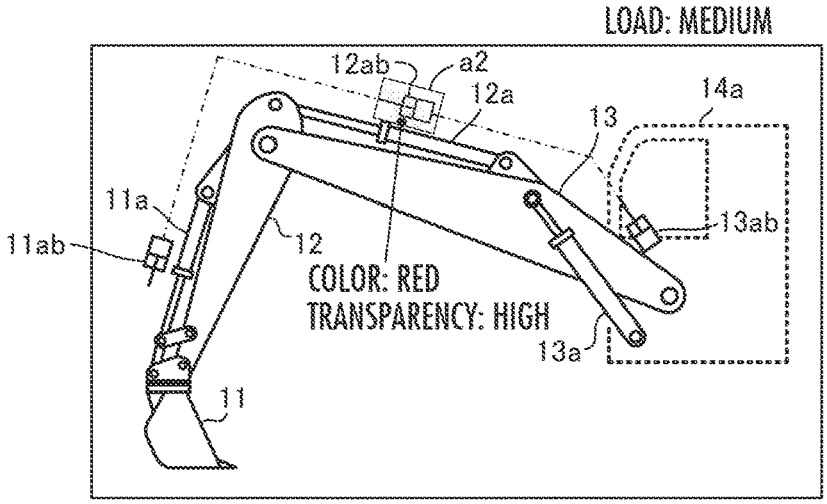
Figure 7C:
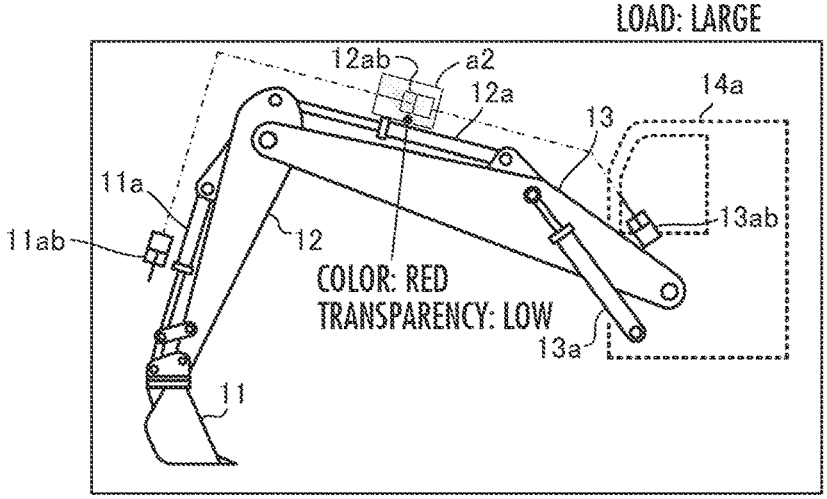

Referring now to FIG. 7A to FIG. 7C, a fourth example will be described. In a low load state (FIG. 7A) in which the loads on all hydraulic cylinders 11*a*, 12*a*, and 13*a* are small loads of a predetermined value or less, an entire operation mechanism state image is shown on a display 44 with certain standard brightness, color intensity, and transparency, as with the first example. In the fourth example, an operation mechanism state image includes diagrams 11*ab*, 12*ab*, and 13*ab* representing the arrangement mode of the actuators (hydraulic cylinders 11*a*, 12*a*, and 13*a*) included in a front operation mechanism 100.

Then, when the load on any one of the hydraulic cylinders 11*a*, 12*a*, and 13*a* becomes larger than the predetermined value, a masking color of a predetermined color (e.g., red) is superimposed on the image of a diagram 11*ab*, or 12*ab* or 13*ab* corresponding to a hydraulic cylinder with increased load X, the load on which has exceeded the predetermined value (hereinafter referred to as the diagram with increased load D), in an operation mechanism state image such that the transparency of the image of the diagram with increased load D is lower than that of the low load state (FIG. 7A) and the transparency of the diagram with increased load D decreases as the load (>predetermined value) of the hydraulic cylinder with increased load X increases.

For example, FIG. 7B and FIG. 7C illustrate situations in which the load on the hydraulic cylinder 12*a* among the hydraulic cylinders 11*a*, 12*a*, and 13*a* has become larger than the predetermined value, and the load on the hydraulic cylinder 12*a* is even higher in FIG. 7C than in FIG. 7B. In these situations, the transparency of the image of a diagram 12*ab* becomes lower than that of the low load state (FIG. 7A) by superimposing the masking color on an area a2 that includes the image of the diagram 12*ab* corresponding to the hydraulic cylinder 12*a* as the hydraulic cylinder with increased load X. Further, the load on the hydraulic cylinder 12*a* is higher in FIG. 7C than in FIG. 7B, so that the transparency of the image of the diagram 12*ab* corresponding to the hydraulic cylinder 12*a* is lower in FIG. 7C than in FIG. 7B. If there are a plurality of hydraulic cylinders with increased load X, then the masking color is superimposed on the image of the diagram with increased load D corresponding to each of the plurality of hydraulic cylinders with increased load X.

Consequently, as with the second example, while operating a work machine 10 without boarding the work machine 10, an operator can visually recognize with ease when the load on any one of the hydraulic cylinders 11*a*, 12*a*, and 13*a* increases, and the high or low degree of the magnitude of the load. In addition, the operator can visually recognize with ease which one of the hydraulic cylinder 11*a*, 12*a*, and 13*a* is the hydraulic cylinder with increased load X. Thus, the operator can properly correct the way of moving a front operation mechanism 100 at an appropriate tinting to reduce the load on the hydraulic cylinder with increased load X. As a result, the occurrence of a failure or the like of the front operation mechanism 100 can be properly prevented.

In the fourth example, when the load on any one of the hydraulic cylinders 11*a*, 12*a*, and 13*a* becomes larger than the predetermined value, instead of or in addition to decreasing the transparency of the image of the diagram with increased load D corresponding to the hydraulic cylinder with increased load X as the load on the hydraulic cylinder with increased load X increases, one or both of the brightness and the color intensity of the diagram with increased load D corresponding to the hydraulic cylinder with increased load X may be changed according to the load on the hydraulic cylinder with increased load X. For example, one or both of the brightness and the color intensity of the image of the diagram with increased load D corresponding to the hydraulic cylinder with increased load X may be increased (or decreased) as the load on the hydraulic cylinder with increased load X increases.

Second Embodiment

A second embodiment of the present invention will now be described with reference to FIG. 8. The present embodiment differs from the first embodiment only in a part of the control processing of an output information control unit 47*a* of a master side control device 47, so that the description of matters that are the same as those of the first embodiment will be omitted.

In the present embodiment, when the load on any one of the actuators (hydraulic cylinders 11*a*, 12*a*, and 13*a*) of a front operation mechanism 100 becomes larger than a predetermined value, the output information control unit 47*a* causes speakers 43 to output an alarm sound and causes a seat 41 to vibrate through the intermediary of a vibration exciter 41*a* in addition to controlling the display of an operation mechanism state image on a display 44 as in the first embodiment, or instead of controlling the display. Further, in this case, the output information control unit 47*a* changes both or one of the frequency and intensity of each of the alarm sound and the vibration of the seat 41 according to the magnitude of the load on a hydraulic cylinder with increased load X. The alarm sound is not limited to a mere acoustic output, but may be a voice (e.g., a voice such as "The load on the hydraulic cylinder ○ is large").

Figure 8:
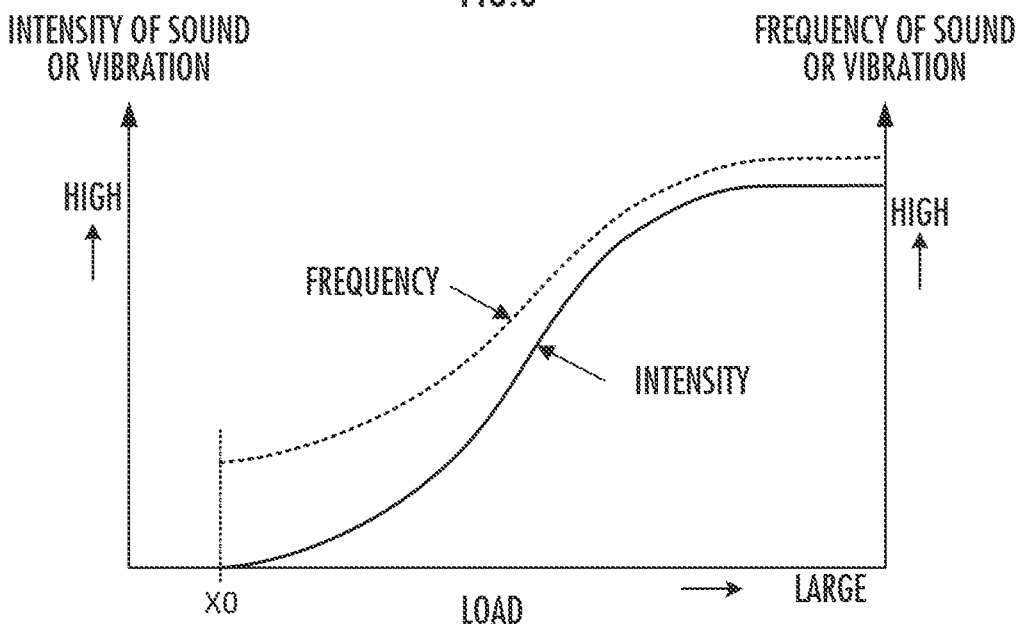
FIG. 8 is a graph for explaining the control mode of a sound or a vibration generated in a second embodiment.

More specifically, referring to FIG. 8, when the load on any one of the actuators (the hydraulic cylinders 11*a*, 12*a*, and 13*a*) of the front operation mechanism 100 becomes larger than a predetermined value X0, the output information control unit 47*a* causes the speakers 43 to output the alarm sound. In this case, the output information control unit 47*a* controls the speakers 43 such that the intensity (volume) of the alarm sound increases as the load on the hydraulic cylinder with increased load X increases, as indicated by, for example, the solid line graph of FIG. 8. Alternatively, the output information control unit 47*a* controls the speakers 43 such that the frequency of the alarm sound increases as the load on the hydraulic cylinder with increased load X increases, as indicated by the dashed line graph of FIG. 8.

In addition, the output information control unit 47*a* controls the vibration exciter 41*a* to change the frequency or the intensity of the vibration of the seat 41 according to the magnitude of the load on the hydraulic cylinder with increased load X as with the alarm sound (e.g., as indicated by the solid line graph or the dashed line graph of FIG. 8).

In the present embodiment, when the load on any one of the actuators (the hydraulic cylinders 11*a*, 12*a*, and 13*a*) of the front operation mechanism 100 becomes larger than a predetermined value, the alarm sound is output from the speakers 43 and the seat 41 is vibrated as described above.

Consequently, while operating a work machine 10 without boarding the work machine 10, an operator can aurally or sensorily recognize with ease when the load on any one of the hydraulic cylinders 11*a*, 12*a*, and 13*a* increases, and the high or low degree of the magnitude of the load. Thus, the operator can correct the way of moving the front operation mechanism 100 at an appropriate timing to decrease the load on the hydraulic cylinder with increased load X. As a result, the occurrence of a failure or the like of the front operation mechanism 100 can be properly prevented.

To output the alarm sound as described above from the speakers 43, audio information indicating which hydraulic cylinder among the hydraulic cylinders 11*a*, 12*a*, and 13*a* has an increased load may be output from the speakers 43 at the timing immediately before the output.

Further, in the processing for changing the frequency or the intensity (volume) of the alarm sound according to the load on the hydraulic cylinder with increased load X, the frequency or the intensity (volume) of the alarm sound may be decreased as the load increases, contrary to the above. The same applies also to the frequency or the intensity of the vibration of the seat 41.

Further, when the load on any one of the actuators (the hydraulic cylinders 11*a*, 12*a*, and 13*a*) of the front operation mechanism 100 becomes larger than the predetermined value, only one of the output of the alarm sound and the vibration of the seat 41 may be performed.

Third Embodiment

A third embodiment of the present invention will now be described with reference to FIG. 9A to FIG. 9C. The present embodiment differs from the first embodiment only in a part of the control processing of an output information control unit 47*a* of a master side control device 47, so that the description of the matters that are the same as those of the first embodiment will be omitted.

In the present embodiment, the output information control unit 47*a* causes a display 44 in front of an operator to continuously display captured images in front of a swivel body 14 photographed by a camera 23 of a work machine 10 while the work machine 10 is in operation (including captured images of a front operation mechanism 100, which will be hereinafter referred to simply as the captured front images). For example, as illustrated in FIG. 9A, the captured front image (the captured front image by the camera 23 in a driver's cab 14*a* in the illustrated example) is shown on the display 44.

Then, in a state in which such a captured front image is being shown on the display 44, when the load on any one of the actuators (hydraulic cylinders 11*a*, 12*a*, and 13*a*) of the front operation mechanism 100 becomes larger than a predetermined value, which is detected from the detection information of the load, the output information control unit 47*a* performs display control of the display 44 so as to change the state amount of one of the brightness, the color intensity, and the transparency of at least a part of the captured front image.

In this case, the display control on the captured front image is performed in the same manner as the display control on the operation mechanism state image described in the first embodiment. For example, if the load on any one of the hydraulic cylinders 11*a*, 12*a*, and 13*a* becomes larger than the predetermined value, then the captured image of a driven part with increased load Y (an attachment 11 or an arm 12 or a boom 13) driven by a hydraulic cylinder with increased load X, the load on which has become larger than the predetermined value, is colored by a predetermined color (e.g., red) among the captured images of the front operation mechanism 100 included in the captured front image, and the colored image is shown on the display 44. Further, the captured image of the driven part with increased load Y is shown on the display 44 such that the brightness or the color intensity of the captured image of the driven part with increased load Y becomes higher than that of the low load state (FIG. 9A), and the brightness or the color intensity of the captured image of the driven part with increased load Y increases as the load (>predetermined value) of the hydraulic cylinder with increased load X increases.

Figure 9B:
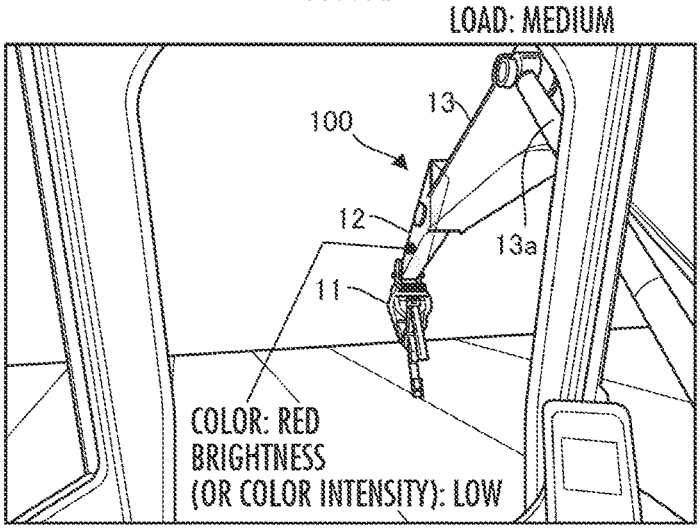
Figure 9C:
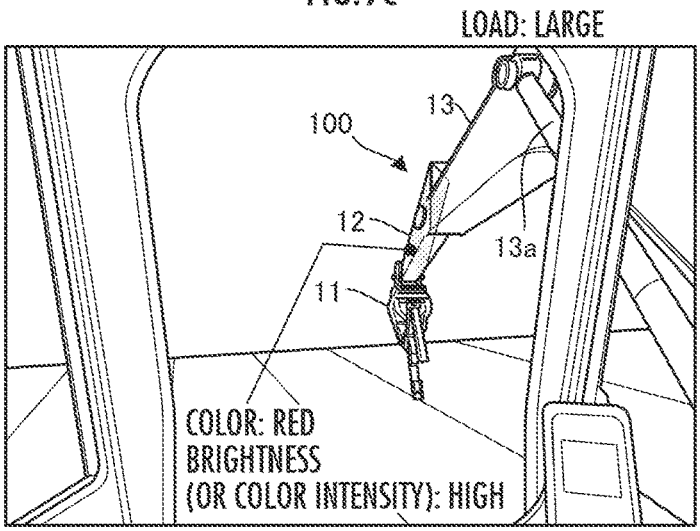

For example, FIG. 9B and FIG. 9C illustrate situations in which the load on the hydraulic cylinder 12*a* among the hydraulic cylinders 11*a*, 12*a*, and 13*a* has become larger than the predetermined value, and the load on the hydraulic cylinder 12*a* is higher in FIG. 9C than in FIG. 9B. In these situations, the brightness or the color intensity of the captured image of the arm 12, which is the driven part with increased load Y corresponding to the hydraulic cylinder 12*a* as the hydraulic cylinder with increased load X, is higher than that of the low load state (FIG. 9A). Further, the load on the hydraulic cylinder 12*a* is higher in FIG. 9C than in FIG. 9B, so that the brightness or the color intensity of the captured image of the arm 12 (the driven part with increased load Y) is higher in FIG. 9C than in FIG. 9B. If there are a plurality of the hydraulic cylinders with increased load X, then the brightness or the color intensity of the image of each of the driven parts with increased load Y individually corresponding to the plurality of hydraulic cylinders with increased load X is set as described above.

Consequently, while operating the work machine 10 without boarding the work machine 10, the operator can visually recognize with ease when the load on any one of the hydraulic cylinders 11*a*, 12*a*, and 13*a* increases, and the high or low degree of the magnitude of the load. In addition, the operator can visually recognize with ease which one of the driven parts, namely, the attachment 11, the arm 12, and the boom 13, is the driven part with increased load Y corresponding to the hydraulic cylinder with increased load X. Thus, the operator can properly correct the way of moving the front operation mechanism 100 at an appropriate timing to decrease the load on the hydraulic cylinder with increased load X that drives the driven part with increased load Y. As a result, the occurrence of a failure or the like of the front operation mechanism 100 can be properly prevented.

Both the brightness and the color intensity of a captured image of the driven part with increased load Y may be changed according to the magnitude of the load on the hydraulic cylinder with increased load X. Further, in addition to or instead of changing one or both of the brightness and the color intensity of the captured image of the driven part with increased load Y according to the magnitude of the load on the hydraulic cylinder with increased load X, the transparency of the captured image of the driven part with increased load. Y may be changed, or the state amount or amounts of one or more of the brightness, the color intensity, and transparency of the hydraulic cylinder with increased load X may be changed according to the magnitude of the load on the hydraulic cylinder with increased load X.

Alternatively, for example, the state amount or amounts of one or more of the brightness, the color intensity, and the transparency of the entire captured front image may be changed according to the magnitude of the load on the hydraulic cylinder with increased load X.

Further, for example, as with the second embodiment, the alarm sound output from the speakers 43 or the vibration of the seat 41 may be controlled in addition to changing the state amount of any one of the brightness, the color intensity, and the transparency of at least a part of the captured front image according to the magnitude of the load on the hydraulic cylinder with increased load X.

The above has described the first to the third embodiments of the present invention, but the present invention is not limited to the embodiments described above, and can also adopt other embodiments. For example, in the foregoing embodiments, the hydraulic excavator has been exemplified as the work machine 10, but the work machine in the present invention may be a work machine such as a crane or a forestry machine. Further, the work machine 10 may be a work machine exclusively designed for remote control.

Further, in the foregoing embodiments, the remote control system 1 of the work machine 10 has been exemplified, but the present invention can be applied also to a work machine operated by an operator aboard.

As described above, the work machine in accordance with the present invention includes: an operation mechanism; a load detection element that detects a load applied to the operation mechanism; an information output device that outputs at least one of an image, a sound, and a vibration to an operator; and a control element that carries out one or more controls among the control of the level of at least one of the color intensity, the brightness, and the transparency of at least a part of an image output by the information output device according to the magnitude of a load on the operation mechanism detected by the load detection element, the control of at least one of the intensity and the level of frequency of a sound output by the information output device, and the control of at least one of the intensity and the level of frequency of a vibration output by the information output device.

According to the work machine in accordance with the present invention, at least one of an "image" in which the level of at least one of color intensity, brightness, and transparency differs at least partly, depending on the magnitude of the load applied to the operation mechanism, a "sound" in which at least one of the intensity and the level of frequency is different, and a "vibration" in which at least one of the intensity and the level of frequency is different is output from an information output device to the operator.

This makes it possible to cause the operator to recognize that the load on the operation mechanism is large before the operation mechanism malfunctions, thus guiding the operator to control the operating state of the work machine including the operation mechanism so that the load is reduced.

Further, in the present invention, the control element can adopt a mode in which control is performed such that the transparency of an area that overlaps at least partly with an image normally displayed among the images output by the information output device decreases as the load on the operation mechanism detected by the load detection element increases. The phrase an "image normally displayed" means an image output by the information output device in a state in which the load on at least the operation mechanism is sufficiently small.

With this arrangement, the control is performed such that the transparency of an area overlapping with an image normally displayed among the images output by the information output device decreases as the load applied to the operation mechanism increases. Consequently, the visibility of a normally displayed image decreases, so that the operator is made more aware of the fact that the load on the operation mechanism is large before the operation mechanism malfunctions, and thus the operator can be more reliably guided to control the operating state of the work machine including the operation mechanism such that the load is reduced.

Further, in the present invention, the operation mechanism can be a mechanism that includes an actuator and a part driven by the actuator. In this case, a mode can be adopted, in which the level of at least one of the color intensity, the brightness, and the transparency of an image part corresponding to at least one of the actuator and the driven part in an image output by the information output device is controlled according to the magnitude of the load on the operation mechanism detected by the load detection element.

According to this mode, the level of at least one of the color intensity, the brightness, and the transparency of an image part corresponding to at least one of the actuator and the driven part of the operation mechanism is controlled according to the magnitude of the load on the operation mechanism. Consequently, when the load applied to the operation mechanism increases, an operator can visually recognize with ease which part of the operation mechanism has the increased load. This enables the operator to appropriately control the operation state of the work machine to reduce the load.

Further, in the present invention, the control element can output a diagram illustrating the arrangement mode of each of a plurality of the operation mechanisms in the work machine to the information output device. In this case, the control element can adopt controlling the level of at least one of the color intensity, the brightness, and the transparency of a part corresponding to each of the plurality of the operation mechanisms in the diagram output by the information output device according to the magnitude of the load on each of the plurality of the operation mechanisms detected by the load detection element.

With this arrangement, as the load applied to each of a plurality of operation mechanisms increases, the level of at least one of the color intensity, the brightness, and the transparency of a part corresponding to each operation mechanism in a diagram, which is output by an information output device and which indicates the arrangement mode of each operation mechanism in a work machine is controlled. This enables an operator to recognize at least one operation mechanism with a relatively large load among a plurality of operation mechanisms, thus making it possible to guide the operator to control the work machine so as to reduce the load on the at least one operation mechanism.

The invention claimed is:

1. A work machine comprising:

an operation mechanism which is a front operation mechanism comprising an attachment, an arm, a boom, and hydraulic cylinders that drive the attachment, the arm, and the boom, respectively;

a load detection element which detects a load applied to the operation mechanism;

an information output device which outputs at east one of an image, a sound, and a vibration to an operator; and a control element which performs one or more controls, according to a magnitude of a load on the operation mechanism detected by the load detection element, among control of a level of at least one of color intensity, brightness, and transparency of at least a part of an image output by the information output device, control of at least one of an intensity and a level of frequency of a sound output by the information output device, and control of at least one of an intensity and a level of frequency of a vibration output by the information output device, wherein the load detection element further comprises a force sensor that is configured to detect a translation force generated by the hydraulic cylinders, and a force sensor that is configured to detect a rotational force of each of the boom, the arm, and the attachment.

2. The work machine according to claim 1, wherein the control element performs control such that transparency of an area that overlaps at least partly with an image normally displayed among images output by the information output device decreases as the load on the operation mechanism detected by the load detection element increases.

3. The work machine according to claim 1, wherein the operation mechanism is a mechanism that includes an actuator and a driven part actuated by the actuator, and a level of at least one of color intensity, brightness, and transparency of an image part corresponding to at least one of the actuator and the driven part in the image output by the information output device is controlled according to the magnitude of the load on the operation mechanism detected by the load detection element.

4. The work machine according to claim 1, wherein the control element causes the information output device to output a diagram indicating an arrangement mode of each of a plurality of the operation mechanisms in the work machine, and a level of at least one of color intensity, brightness, and transparency of a part corresponding to each of the plurality of the operation mechanisms in the diagram output by the information output device is controlled according to the magnitude of the load on each of the plurality of the operation mechanisms detected by the load detection element.

* * * * *